US005913361A

United States Patent [19]

Engström et al.

[11] Patent Number: 5,913,361

[45] Date of Patent: Jun. 22, 1999

[54] PLATE HEAT EXCHANGER

[75] Inventors: Anders Engström, Karlskrona; Ralf Blomgren, Skanör, both of Sweden

[73] Assignee: Alfa Laval AB, Lund, Sweden

[21] Appl. No.: 08/981,312

[22] PCT Filed: Jun. 6, 1996

[86] PCT No.: PCT/SE96/00745

§ 371 Date: Dec. 10, 1997

§ 102(e) Date: Dec. 10, 1997

[87] PCT Pub. No.: WO96/41995

PCT Pub. Date: Dec. 27, 1996

[30] Foreign Application Priority Data

Jun. 13, 1995 [SE] Sweden ..... 9502135

[51] Int. Cl.[6] ..... F28F 3/08

[52] U.S. Cl. ..... 165/70; 165/167

[58] Field of Search ..... 165/70, 167

[56] References Cited

U.S. PATENT DOCUMENTS

| | | | |
|---|---|---|---|
| 3,099,520 | 7/1963 | Hallstrom | 165/70 X |
| 4,372,375 | 2/1983 | Bond | 165/70 |
| 4,903,758 | 2/1990 | Cowan | 165/70 X |
| 4,976,313 | 12/1990 | Dahlgren et al. | 165/167 |
| 5,193,612 | 3/1993 | Stirnkorb | 165/167 |

FOREIGN PATENT DOCUMENTS

| | | | |
|---|---|---|---|
| 2713977 | 10/1978 | Germany | 165/70 |
| 13308 | 9/1991 | WIPO | 165/167 |
| 17404 | 11/1991 | WIPO | 165/167 |
| 18253 | 11/1991 | WIPO | 165/167 |

*Primary Examiner*—Leonard Lee
*Attorney, Agent, or Firm*—Fish & Richardson P.C.

[57] ABSTRACT

In a plate heat exchanger, having double-walled plate formed heat transfer elements (1, 2), adjacent such heat transfer elements are permanently brazed together by means of three different and spaced brazing joints. A first brazing joint surrounds an area, which covers the heat transfer portions (3, 4) of the heat transfer elements and first inlet openings and outlet openings (8, 9) communicating with a flow passage (6) that is formed between said heat transfer portions. A second joint and a third joint surround respective inlet openings and outlet openings (10, 11), which are closed from communication with said flow passage (6). Leakage areas (16–19; 39), which communicate with the surrounding of the plate heat exchanger, are formed between said first joint and each one of said other joints.

8 Claims, 6 Drawing Sheets

PLATE HEAT EXCHANGER

FIELD OF THE INVENTION

The present invention relates to a plate heat exchanger for heat transfer between a first fluid and a second fluid, in which plate heat exchanger plate formed heat transfer elements are permanently joined together to a plate package and between themselves delimit in alternate interspaces first flow passages for said first fluid and second flow passages for said second fluid, respectively; each heat transfer element comprises two plates abutting against each other and having through-openings aligned with each other; and said through-openings in the plates of the heat transfer elements form a first inlet channel and a first outlet channel through the plate package, which channels communicate with said first flow passage and are closed from communication with said second flow passages, and a second inlet channel and a second outlet channel through the plate package, which channels communicate with said second flow passages and are closed from communication with said first flow passages.

BACKGROUND OF THE INVENTION

Plate heat exchangers in which every plate formed heat transfer element consists of two plates abutting against each other are previously known. A conventional openable plate heat exchanger of this kind is shown for instance in U.S. Pat. No. 4,976,313. Owing to the fact that each heat transfer element comprises two plates it is achieved a safety against getting the two heat exchange fluids, flowing on respective sides of the heat transfer element, mixed with each other within the plate heat exchanger, if a hole would be formed through one of the plates. A leakage of one of the fluids through a hole of this kind makes the fluid in question flowing out into the space between the plates and further therethrough to and past the edges of the plates, where the leakage can be observed. So that the heat exchange fluids during normal operation of the plate heat exchanger shall not flow out into the spaces between the plates in the respective heat transfer elements the plates in each heat transfer element have to seal against each other around their said through-openings. Sealing of this kind can be obtained for instance through welding, brazing or gluing.

Even plate heat exchangers having permanently joined heat transfer elements, each comprising two plates abutting against each other, are previously known. Plate heat exchangers of this known kind, in which the double-walled heat transfer elements are joined through brazing, are shown and described in EP 517 785 and EP 527 875.

A drawback with these known brazed plate heat exchangers is that the double-walled heat transfer elements are brazed together with each other in a conventional manner, i.e. in the same manner as single-walled heat transfer elements in a brazed plate heat exchanger. The adjacent heat transfer elements are, thus, joined with each other by means of a single continuous brazing joint, and if this brazing joint is not close or does not keep tight, there is a risk that the heat exchange fluids despite the double-wall arrangement are mixed with each other in the plate heat exchanger without this being noticed.

SUMMARY OF THE INVENTION

The object of the present invention is to provide a plate heat exchanger having permanently joined double-walled heat transfer elements, which is safer than previously known plate heat exchangers of this kind against mixing of the heat exchange fluids in the plate heat exchanger without this being noticed.

This object is obtained according to the invention by the adjacent heat transfer elements being joined together in each of said interspaces by means of three different and spaced joints, a first joint of which surrounds an area covering the flow passage that is delimited in the interspace as well as the inlet channel and the outlet channel through the plate package, which channels communicate with the flow passage, whereas a second one and a third one of said joints surrounds the one of said inlet channels and the one of said outlet channels, respectively, which constitute by-pass channels and are closed from communication with the flow passage in the interspace, and by leakage areas in said interspace, which are situated between said first joint and the respective one of said second and third joints, communicating with the surrounding of the plate heat exchanger.

The invention concerns plate heat exchangers in general, having permanently joined heat transferring elements. For the joining of the heat transfer elements it is possible to use for instance welding, brazing or gluing.

In practice, the heat transfer elements of a brazed plate heat exchanger are often rectangular and pressed in a way such that relatively large plane corner portions thereof are brazed together in pairs around each one of those inlet channels and outlet channels which extend through the plate package. A special embodiment of the invention therefore concerns a brazed plate heat exchanger, in which said adjacent heat transfer elements have plane surfaces in said interspace, which are facing each other and delimit between themselves said leakage areas as well as at least parts of said three joints, the joints being constituted by brazing joints or gluing joints and being formed by a connection or bonding material, and the leakage areas being free of bonding material.

When a leakage area is to be delimited in this way by and between two plane portions of two heat transfer elements, facing and abutting against each other, which plane portions should simultaneously be partly brazed or glued together by means of a bonding material, at least one of the plane portions opposite to the leakage area may be covered on its surface with a substance preventing the surface from being wetted by said bonding material when the latter is in a liquid state. Brazing technique for making possible such partial brazing together of two plane surfaces facing each other is known from for instance the publication "Brazing: For the Engineering Technologist" (Author: M. Schwartz. Publisher: Chapman & Hall, London, UK).

In a plate heat exchanger according to the invention one of said leakage areas may extend between said first joint and one of said second and third joints from one part to another of the edge surrounding each one of the adjacent heat transfer elements. However, it is preferred that the leakage areas extend around the respective ones of said by-pass channels.

Within the scope of the invention a leakage area of the above said kind may be delimited by different parts of two adjacent heat transfer elements. One possibility is that it is delimited by and between the two plates of the heat transfer elements situated closest to each other. In this case the leakage area may communicate with the surrounding of the plate heat exchanger either in a way such that part of the leakage area extends out to the edges of the heat transfer elements, or through a hole in at least one of said plates and, thus, through the space between this plate and the further plate of the same heat transfer element.

Another possibility is that the leakage area is delimited by and between the plates of the two heat transfer elements, situated most remote or farthest from each other. In this case these two plates have through-openings which are smaller than the aligned openings of the two plates of the heat transfer elements, which are situated closest to each other. Furthermore, in this case the plates situated farthest from each other are sealingly connected directly or indirectly with each other around their said openings, the leakage area being formed and extending around the connection area. Even in this case the leakage area communicates with the surrounding of the plate heat exchanger through the space between the plates in at least one of the two heat transfer elements.

It shall be noticed that the above said space between the two plates in each heat transfer element may be microscopically thin, i.e. it need not be larger than the interspace that is formed between two plane plates abutting closely against each other.

BRIEF DESCRIPTION OF THE DRAWINGS

The invention is described in the following with reference to the accompanying drawings, in which.

DETAILED DESCRIPTION

Figure 1:
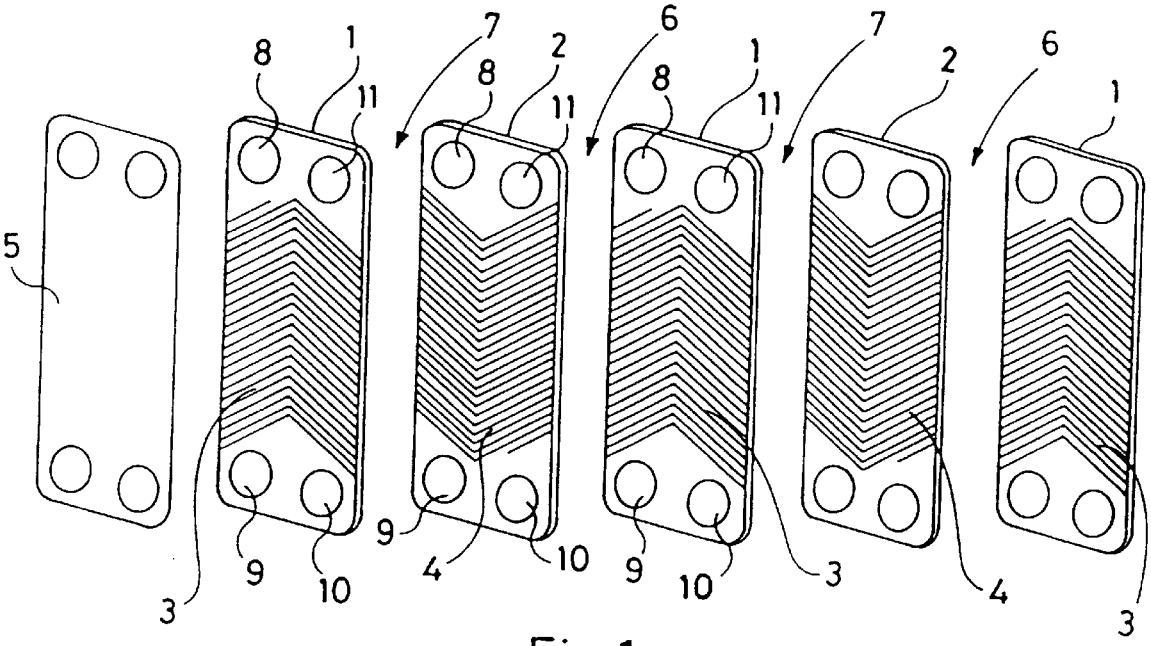
FIG. 1 shows a number of double-walled heat transfer elements arranged as in a plate heat exchanger according to the invention but spaced from each other.

FIG. 1 shows five rectangular double-walled heat transfer elements 1, 2 having corrugated heat transfer portions 3, 4 and a plane end plate 5. The latter is intended to form together with the heat transfer elements 1, 2 a part of a plate package to be included in a permanently joined so called brazed plate heat exchanger. In the plate heat exchanger there are delimited between the heat transfer elements 1, 2 alternating first flow passages 6 and second flow passages 7 for the respective ones of two fluids, between which heat is to be transferred through the heat transfer elements. The flow passages 6 and 7 are formed owing to the corrugations of the heat transferring portions 3, 4 of the heat transfer elements 1, 2 forming ridges and valleys, the ridges of adjacent heat transfer elements crossing and abutting against each other.

For access of the fluids to the flow passages 6 and 7, respectively, the heat transfer elements 1, 2 have in their corner portions through-openings 8–11, which form inlet channels and outlet channels through the plate package. Even the end plate 5 has corresponding openings aligned with the openings 8–11.

The openings 8 and 9 in the heat transfer elements 1, 2 form inlet channels and outlet channels, respectively, for one of said fluids. These inlet channels and outlet channels communicate with said first flow passages 6 but are closed from connection with said second flow passages 7. The openings 10 and 11 form inlet channels and outlet channels, respectively, for the second fluid, which inlet channels and outlet channels communicate instead with the flow passages 7 but are closed from connection with the flow passages 6. The flow paths described here through the plate heat exchanger according to FIG. 1 are formed owing to the heat transfer elements 1, 2 being brazed together in the following manner.

Two adjacent heat transfer elements 1, 2, which delimit between themselves a flow passage 6, are brazed together around their edge portions. Furthermore, they are brazed together around their respective openings 10 and 11, which are formed in the corner portions of the two heat transfer elements. These corner portions are situated in the same plane as the crests of the corrugation ridges of the two heat transfer elements, which cross and abut against each other in the flow passage 6.

In a corresponding way two adjacent heat transfer elements, which between themselves delimit a flow passage 7, are brazed together. In this case, however, the heat transfer elements are instead brazed together—apart from along their edges—around their respective openings 8 and 9.

Figures 2A, 2B, 2C:
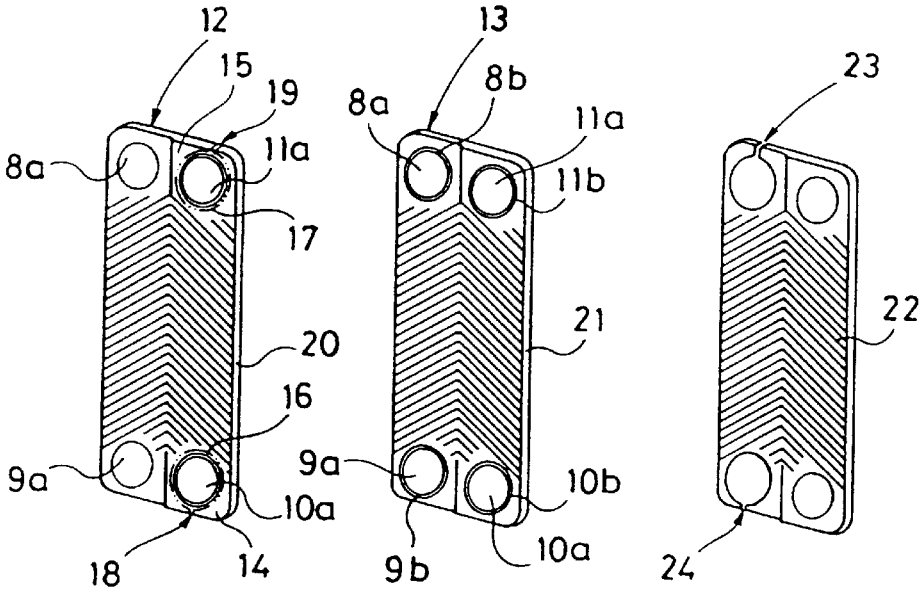
FIGS. 2A and 2B show two plates, which are to be included in one and the same double-walled heat transfer element of the kind shown in FIG. 1.
FIG. 2C shows a thin foil of a bonding or brazing material intended for joining of two heat transfer elements according to FIG. 1.

FIGS. 2A and 2B show two plates 12 and 13, which abutting against other shall form a double-walled heat transfer element 1 of the kind shown in FIG. 1. As can be seen from the FIGS. 2A and 2B the plates 12 and 13 have the same press pattern of ridges and valleys, so that when these plates come to abutment against each other there will be formed a surface contact between them. Preferably, the plates have been pressed simultaneously in contact with each other, so that surface contact comes up between them across the whole of their surfaces facing each other.

The plates 12 and 13 have aligned openings 8*a*–11*a*. In annular areas 8*b*–11*b* around the openings 8*a*–11*a* the plates are intended to be brazed together, so that fluids flowing through channels in the plate heat exchanger formed by the openings 8*a*–11*a*, cannot flow out between the plates 12, 13. The plates 12 and 13 are not brazed together at other places than around the openings 8*a*–11*a*.

In FIG. 2A the numerals 14 and 15 designate the corner portions of the plate 12, through which the plate 12 is intended to be brazed together with a plate in an adjacent heat transfer element. By dash-dot lines 16 and 17 there are illustrated in FIG. 2A two annular surfaces on the corner portions 14, 15, which extend around the openings 10*a* and 11*a*, respectively, and through which the plate 12 shall not be brazed together with the just mentioned plate in an adjacent heat transfer element. Even along a further surface 18 of the plate 12, which extends from the surface 16 to the edge of the plate 12, the plate 12 is to be free from brazing connection with said adjacent heat transfer element. A similar further surface 19 exists in connection with the annular surface 17. The edge portions of the plates 12 and 13, which are bent in the same direction, are designated 20 and 21, respectively, in the FIGS. 2A and 2B.

FIG. 2C shows a thin foil 22 of a brazing material, which is formed and intended for brazing together of a heat transfer element consisting of the plates 12 and 13 with a further heat transfer element situated closest to the plate 13. It is thus the plate 13 which is to be brazed together with one of the plates in the further heat transfer element. Then, surfaces corresponding to the surfaces 16–19 are to be present in connection with the openings 8*a* and 9*a* of the plate 13, which is illustrated in FIG. 2C in a way such that brazing material is missing in small areas 23 and 24.

Before brazing together of the heat transfer elements 1, 2 there is applied onto said surfaces 16–19 in every second interspace, and onto the corresponding surfaces in the other interspaces—at least on one of the plates to be brazed together—a substance having the effect that the plates on these surfaces cannot be wetted by the brazing material used, when this is in a liquid state. Hereby, the plates will remain free of brazing material and, thus, will not be brazed together with each other through these surfaces when the brazing material has solidified.

In a brazed plate heat exchanger of the kind now described with reference to the FIGS. 1 and 2A–C adjacent heat transfer elements will be brazed together by means of three separate and spaced brazing joints. Thus, in an interspace, in which a flow passage 6 is delimited, a first brazing joint will extend around the edges of the heat transfer elements. A second brazing joint will extend around the openings 10 and a third brazing joint around the openings 11. Between the heat transfer elements there will be left opposite to the surfaces 16–19 areas in which there will be no brazing material. These areas separate the first brazing joint from the second brazing joint as well as from the third brazing joint.

Thanks to this arrangement of brazing joints a fluid, which for some reason leaks through or past one of said brazing joints close to one of the openings 10 and 11, will flow furtheron through one of said areas, that is free from brazing material, to and past the edges of the heat transfer elements to the surrounding of the plate heat exchanger.

Figure 3:
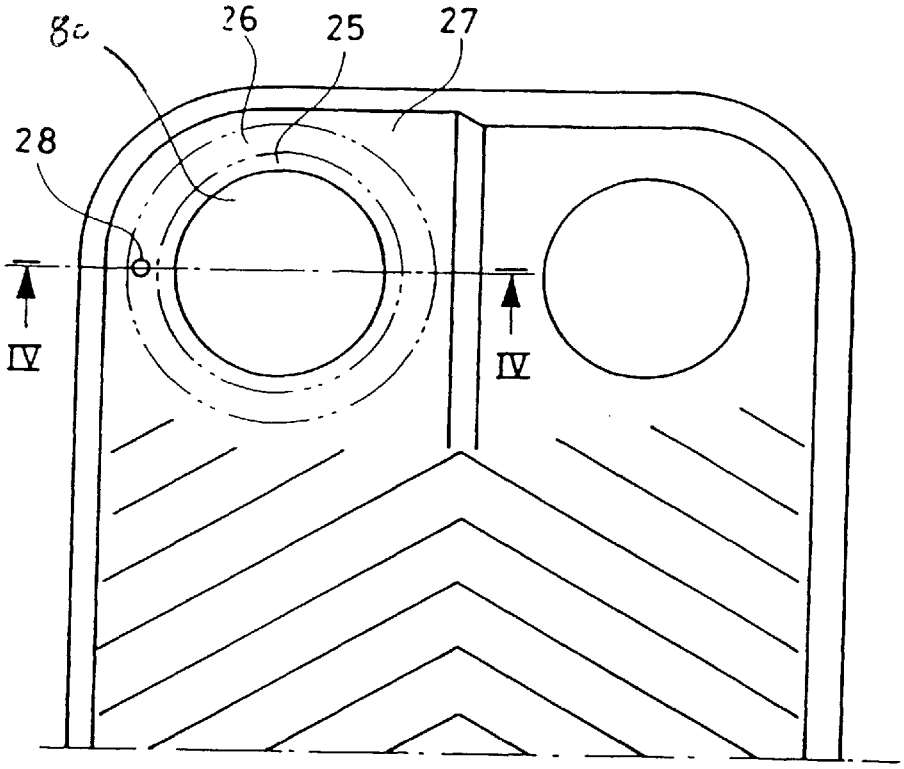
FIG. 3 shows a special embodiment of a plate to be included in one heat transfer element.

FIG. 3 shows a part of a heat transfer element formed differently than according to the FIGS. 2A and 2B. An annular surface 25 extends around and closest to an opening 8*c*, and therearound extends a further annular surface 26. Around the surface 26 there is a surface 27 covering the whole of the corner portion of the heat transfer element around the surface 26.

The shown heat transfer element is intended to be brazed together with an adjacent heat transfer element through the surfaces 25 and 27, whereas the surface 26 is intended to be free of brazing material and, thus, delimit an annular area between the two heat transfer elements which are brazed together. This area is free of brazing material and can receive and conduct a flow of liquid which for some reason has leaked past one of the brazing joints opposite to the surfaces 25 and 27.

Instead of being conducted further to the edges of the heat transfer elements a liquid flow of this kind is conducted in this case through a hole 28 in one of the plates in the heat transfer element shown in FIG. 3. Since the two plates of the heat transfer element are not brazed together more than at a narrow annular surface around each opening, corresponding to the surface 25, liquid flowing through the hole 28 will be able to flow furtheron between the plates to and past their edges to the surrounding of the plate heat exchanger.

Figure 4:
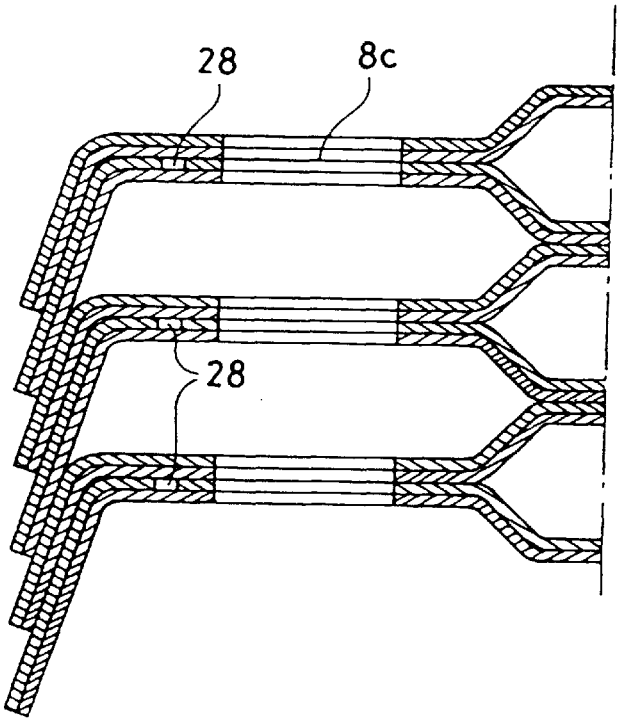
FIG. 4 shows a section through several heat transfer elements, some of which comprise a plate formed in accordance with FIG. 3, FIGS. 5–10 show sections through parts of heat transfer elements formed in different ways in accordance with the invention.

FIG. 4 shows a section through parts of six double-walled heat transfer elements, of the kind shown in FIG. 3, which are brazed together in pairs around their openings 8*c*.

Figure 5:
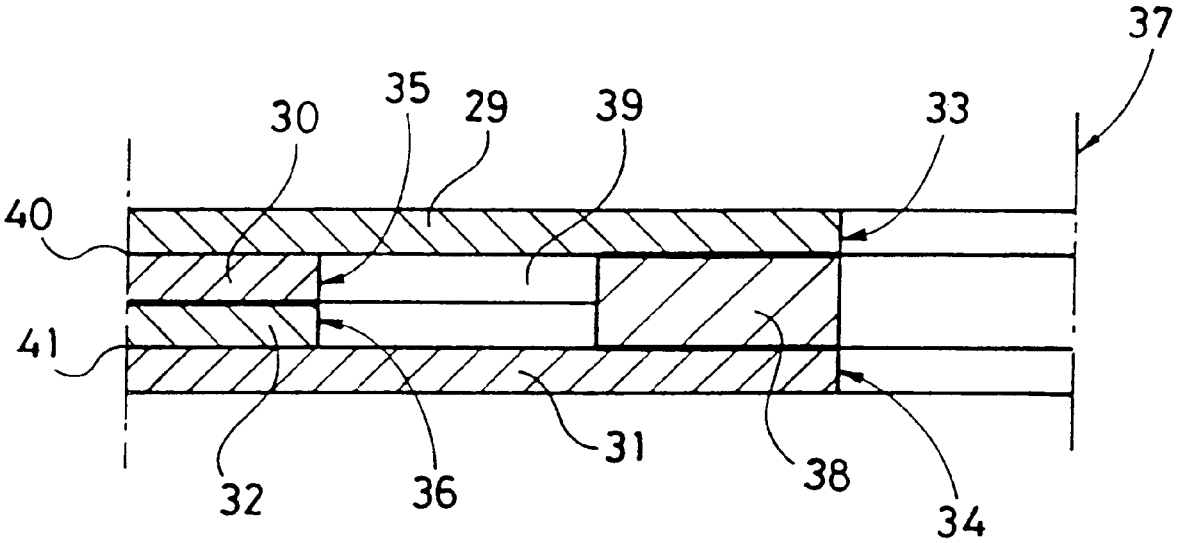

FIG. 5 illustrates a further embodiment of the invention. A first heat transfer element comprising two plates 29, 30 is brazed together with a second heat transfer element comprising two plates 31, 32. The plate 29 has a through-opening 33 (corresponding to for instance the opening 11*a* in the plate 12 in FIG. 2A) and the plate 31 has a corresponding opening 34 of the same size. Corresponding openings in the plates 30 and 32 are larger than the openings 33 and 34 and are designated in FIG. 5 by the numerals 35 and 36, respectively. The openings 33, 34 and 35, 36 have a common centre axis 37. The space hereby formed between the plates 29 and 31 is partly filled out, closest to the openings 33, 34, by a ring 38 that is brazed together around the openings 33, 34 with the plate 29 as well as the plate 31. The rest of said space forms a leakage area 39 between the adjacent heat transfer elements. The leakage area 39 extends around the ring 38 and is delimited by, apart from the ring 38 and the plates 29, 31, the edges of the plates 30, 32. The plates 30, 32 are brazed together along these edges.

In the arrangement according to FIG. 5 the brazing joint between the plates 30 and 32 delimits a flow passage (not shown) for a first fluid between the heat transfer elements 29, 30 and 31, 32, whereas the plates 29 and 31, the ring 38 and the brazing joints between the ring 38 and the plates 29 and 31 delimit an inlet channel or an outlet channel through the plate heat exchanger for a second fluid. If one of said brazing joints would prove not to be tight, one of said fluids will flow through or past the leaking brazing joint out into the leakage area 39. From there, the fluid will flow furtheron between the plates 29, 30 and/or between the plates 31, 32 in spaces 40, 41 formed between these plates. The fluid will flow furtheron in one or both of the spaces 40, 41 to the surrounding of the plate heat exchanger across the edges of the plates.

Figure 6:
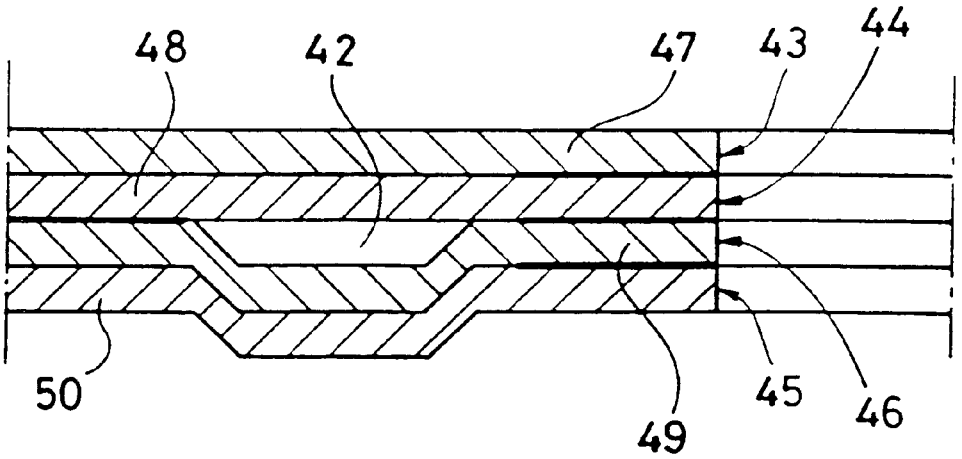

FIG. 6 shows an embodiment of the invention similar to the one shown in the FIGS. 3 and 4. A groove is formed in one of the heat transfer elements, so that an annular leakage space 42 is formed, extending around the through-openings 43–46 in the four plates 47–50 included in the heat transfer elements.

Figure 7:
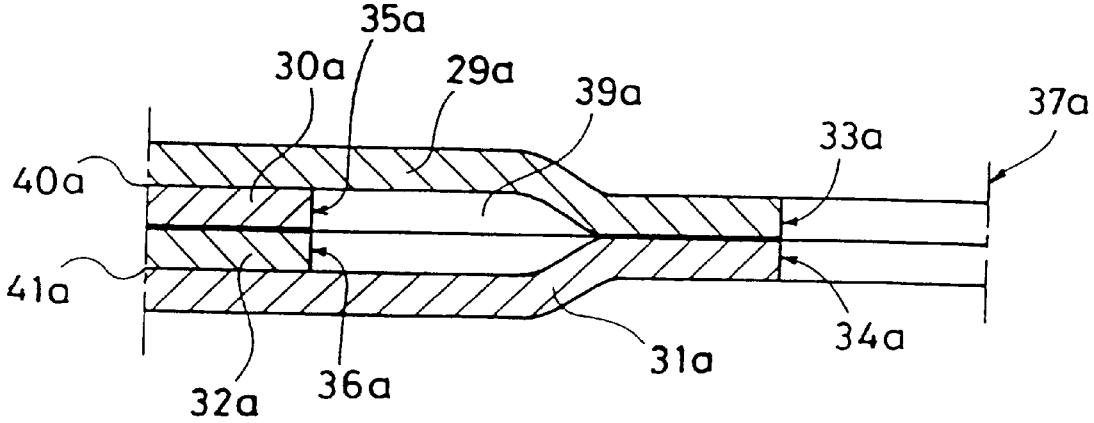
Figure 8:
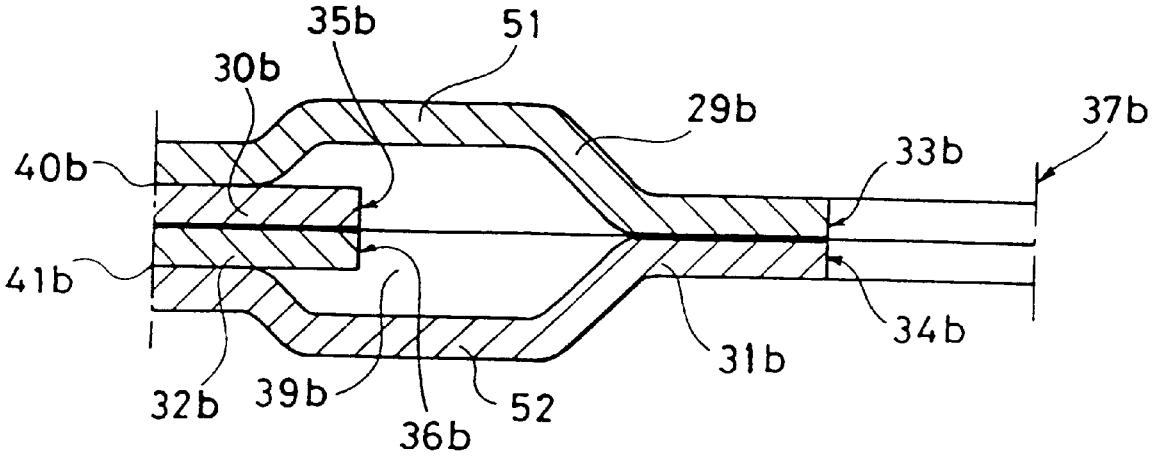

FIGS. 7 and 8 show embodiments of the invention, which are of principally the same kind as the embodiment according to FIG. 5. The same numerals as used in FIG. 5 have been used, therefore, in the FIGS. 7 and 8 with the addition of the letters a and b, respectively, for details corresponding to each other in the different figures.

One difference is that the ring 38 according to FIG. 5 is missing in the FIGS. 7 and 8 and that, instead, the two plates 29*a*, 31*a* and 29*b*, 31*b*, respectively, which are situated farthest from each other, are brazed together directly with each other around their openings 33*a*, 34*a* and 33*b*, 34*b*, respectively.

The embodiment according to FIG. 8 differs from the one in FIG. 7 in that the plates 29*b* and 31*b* have been provided with annular depressions 51 and 52, respectively, opposite to the leakage space 39*b*. The purpose of these depressions is that the leakage space 39*b* shall be able to receive some liquid brazing material without this causing blockage of the connections between the leakage space 39*b* and the spaces 40*b*, 41*b* between the plates 29*b*, 30*b* and the plates 31*b*, 32*b*, respectively. As can be seen, the plates 30*b*, 32*b* around their openings 35*b*, 36*b* have edge portions extending a distance into the leakage area 39*b*.

Figure 9:
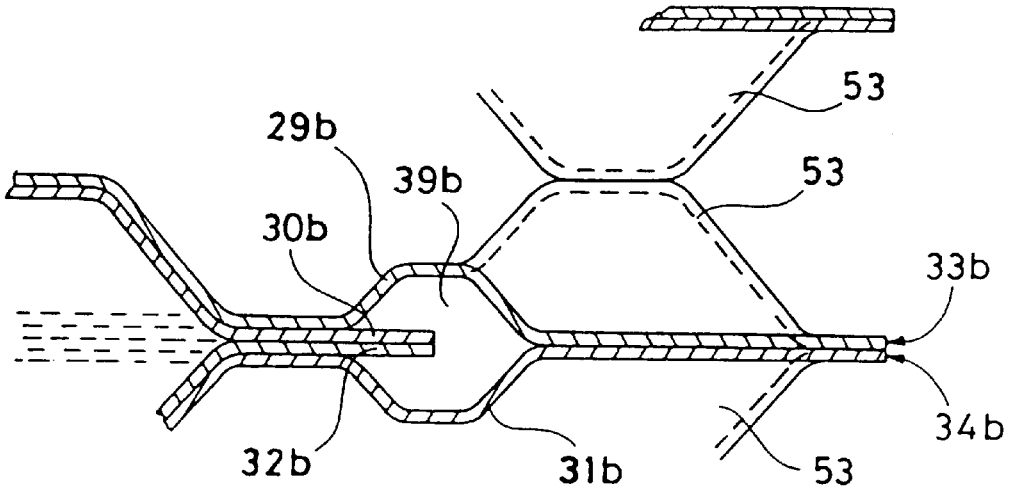

FIG. 9 shows a further development of the embodiment according to FIG. 8. Thus, the plates 29*b* and 31*b* have been provided with protuberances 53 on their sides turned away from each other. The protuberances 53, which are several in each plate, are situated between the leakage area 39*b* and the openings 33*b*, 34*b* and are distributed with mutual interspaces around the openings 33*b*, 34*b*. Protuberances 53 formed on adjacent heat transfer elements and facing each other are brazed together.

Figure 10:
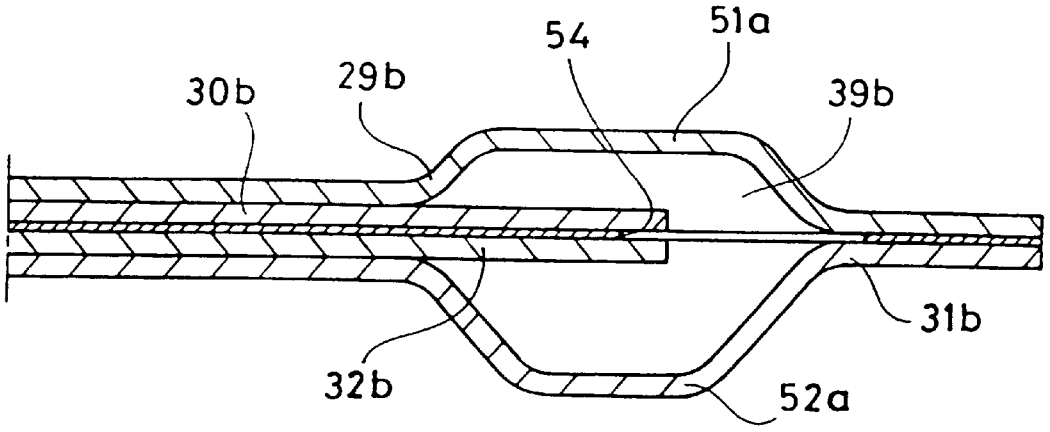

FIG. 10 shows another further development of the embodiment according to FIG. 8. As can be seen the annular depression 52*a* in the plate 31*b* has been made deeper than the depression 51*a* in the plate 29*b*, so that even more liquid brazing material could be collected in the leakage area 39*b* without risk for blocking of its connection with the spaces between the plates 29*b*, 30*b* and 31*b*, 32*b*, respectively. As illustrated at 54 the foil of brazing material has further been formed in a way such that the risk for an access of brazing material should be collected in the leakage area 39*b* has been reduced.

Figure 11:
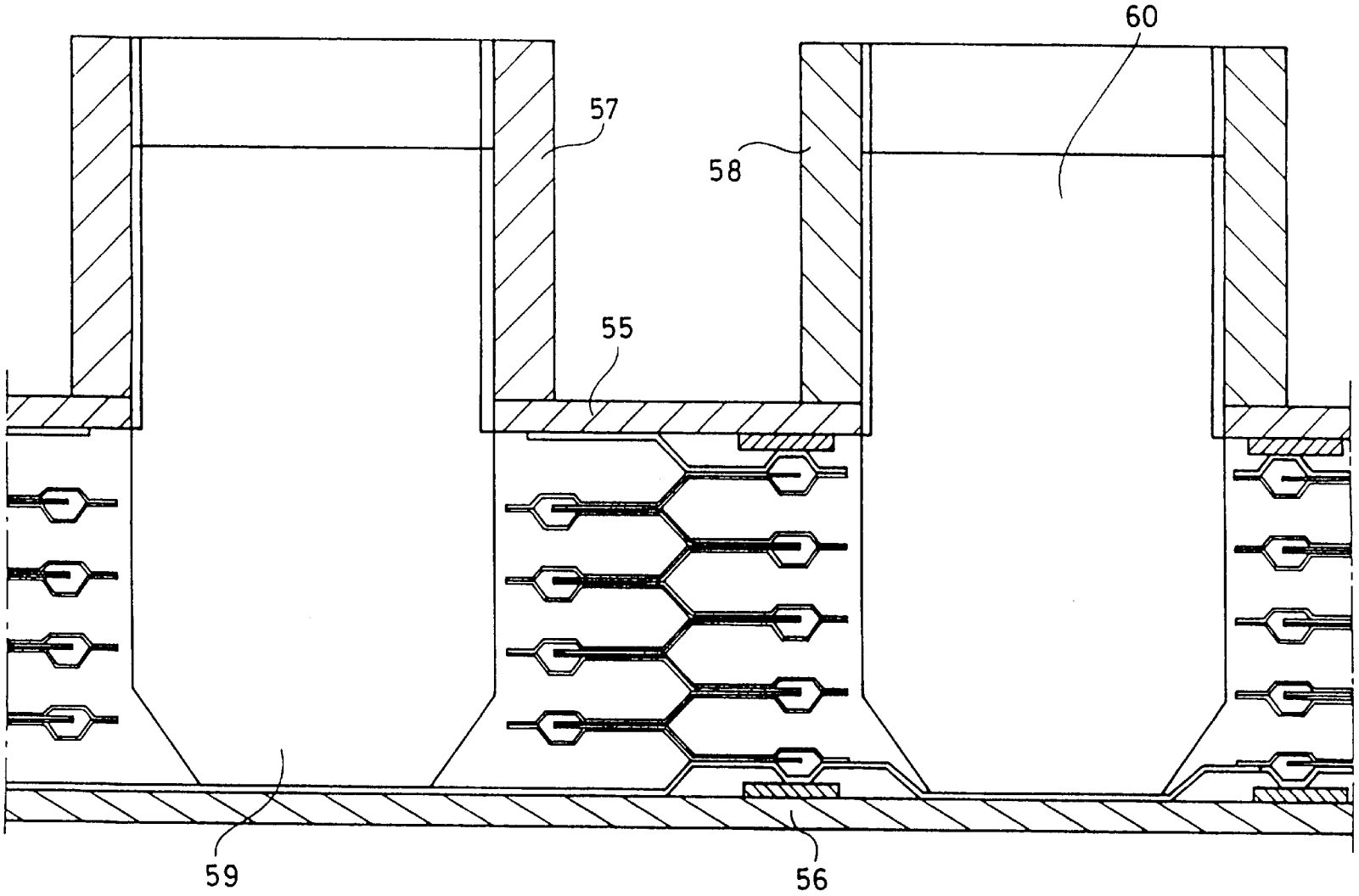
FIG. 11 shows a section through a plate heat exchanger, comprising heat transfer elements in accordance with FIG. 10.

FIG. 11 shows a sect ion through part of a brazed plate heat exchanger comprising double-walled heat transfer elements of the kind shown in FIG. 10.

The heat transfer elements are arranged between two end plates 55 and 56. The end plate 55 has an inlet pipe 57 for a first fluid and an outlet pipe 58 for a second fluid. These pipes are connected aligned with the respective through-openings of the heat transfer elements, which openings form an inlet channel and an outlet channel, respectively, through the plate heat exchanger.

A reinforcing member 59 which is brazed together with both the end plate 56 and with the inlet pipe 57, extends through the inlet channel for said first fluid. A similar reinforcing member 60 extends through the outlet channel for said second fluid and is brazed together with the end plate 56 and the outlet pipe 58. The reinforcing members 59 and 60 are needed to keep together the package of heat transfer elements, since each one of the heat transfer elements comprises two plates which are joined with each other through brazing only in the areas around the heat exchange fluid inlet channels and outlet channels through the plate heat exchanger. The various heat transfer elements, however, are brazed together—in addition to around their edges—at a lot of places across their corrugated heat transfer portions.

What is claimed is:

1. A plate heat exchanger for heat transfer between a first fluid and a second fluid, in which plate-formed heat transfer elements (1, 2) are permanently joined together in a plate package and said elements form between themselves, in alternating interspaces, first flow passages for said first fluid and second flow passages for said second fluid, each of said heat transfer elements (1, 2) comprises two plates (12, 13) abutting against each other and having through-openings (8*a*–11*a*) aligned with each other, and said through openings in the plates of the heat transfer elements form a first inlet channel and a first outlet channel through the plate package, which channels communicate with said first flow passages and are closed from connection with said second flow passages, and a second inlet channel and a second outlet channel through the plate package, which channels communicate with said second flow passages and are closed from connection with said first flow passages, wherein adjacent heat transfer elements (1, 2) are joined together in each of said interspaces (6) by means of three different and spaced permanent joints, a first joint of which surrounds an area covering the flow passage that is formed in the interspace (6) as well as the inlet channel (8) and the outlet channel (9) through the plate package, which channels communicate with the covered flow passage, and wherein a second one and a third one of said joints surround the one (10) of said inlet channels and the one (11) of said outlet channels, respectively, which constitute bypass channels and are closed from communication with the covered flow passage in the interspace (6), and further wherein leakage areas (16–19) in said interspace (6), which are situated between said first joint and the respective one of said second and third joints, communicate with the surrounding of the plate heat exchanger.

2. The plate heat exchanger according to claim 1, in which said two adjacent heat transfer elements (1, 2) have plane surfaces (25–27) in said interspace, which surfaces are facing each other and delimit between themselves said leakage areas as well as at least parts of said three joints, the joints being constituted by brazing or gluing and being formed by a connection or bonding material, and the leakage areas being free of said connection or bonding material.

3. The plate heat exchanger according to claim 1, in which the leakage areas surround the respective ones of said by-pass channels.

4. The plate heat exchanger according to claim 1, in which each one of said leakage areas communicates with the surrounding of the plate heat exchanger through a space between the plates in at least one of said adjacent heat transfer elements.

5. The plate heat exchanger according to claim 4, in which each one of said leakage areas communicates with said space through a hole (28) in the one of the plates in a heat transfer element, which delimit the leakage area in question.

6. The plate heat exchanger according to claim 1, in which each one of the plates (30, 32; 30*a*, 32*a*) of the adjacent heat transfer elements, which plates are situated closest to each other and delimit the flow passage in said interspace, has those (35, 36; 35*a*, 36*a*) of its through-openings, which are closed from communication with the flow passage, larger than the aligned openings (33, 34; 33*a*, 34*a*) of the other plates (29, 31; 29*a*, 31*a*) in the heat transfer elements, which are situated farthest from each other, said plates (29, 31; 29*a*, 31*a*) situated farthest from each other are permanently joined together—directly or indirectly—in a connection area around each one of said by-pass channels, and one of said leakage areas (39; 39*a*) surrounds said connection area and is delimited by said plates (29, 31; 29*a*, 31*a*) situated farthest from each other.

7. The plate heat exchanger according to claim 6, in which at least one of said plates (29*b*, 31*b*) situated farthest from each other in the adjacent heat transfer elements has a groove, which is open towards said leakage area (39*b*) and extends around said by-pass channel.

8. The plate heat exchanger according to claim 1, in which said adjacent heat transfer elements, delimiting said interspace, have surrounding edge portions, which are permanently joined together except in limited areas (18, 19), which communicate with said leakage areas (16, 17).

* * * * *